US009003562B2

(12) United States Patent
Clauson et al.

(10) Patent No.: US 9,003,562 B2
(45) Date of Patent: Apr. 14, 2015

(54) BODY ARMOR

(75) Inventors: Michael J. Clauson, Warren, MI (US); Marilyn M. Peterson, St. Clair Shores, MI (US); Michael Nranian, South Lyon, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 342 days.

(21) Appl. No.: 13/547,610

(22) Filed: Jul. 12, 2012

(65) Prior Publication Data

US 2014/0013477 A1 Jan. 16, 2014

(51) Int. Cl.

| | |
|---|---|
| ***F41H 1/02*** | (2006.01) |
| ***A41D 27/16*** | (2006.01) |
| ***A41D 27/12*** | (2006.01) |
| ***A41D 5/00*** | (2006.01) |
| *F41H 5/04* | (2006.01) |

(52) U.S. Cl.

CPC ..... *F41H 1/02* (2013.01); *F41H 5/0485* (2013.01); *F41H 5/0492* (2013.01)

(58) Field of Classification Search

CPC ..... A41F 1/02; A41F 5/0485; A41F 5/0492
USPC ..... 2/2.5, 456, 460, 461, 462, 467
See application file for complete search history.

(56) References Cited

U.S. PATENT DOCUMENTS

| | | | | |
|---|---|---|---|---|
| 807,857 | A | | 12/1905 | Palmenberg |
| 1,269,019 | A | | 6/1918 | Szmyt |
| 1,639,815 | A | | 8/1927 | Siebrandt |
| 1,772,922 | A | | 8/1930 | Volz |
| 2,670,228 | A | | 2/1954 | Pagliuso |
| 2,752,116 | A | | 6/1956 | Minnis |
| 3,331,083 | A | * | 7/1967 | Holly ..... 2/2.5 |
| 3,452,362 | A | * | 7/1969 | Korolick et al. ..... 2/2.5 |
| 4,708,510 | A | | 11/1987 | McConnell et al. |
| 5,385,536 | A | | 1/1995 | Burkhead et al. |
| 5,868,652 | A | * | 2/1999 | Spletzer ..... 482/105 |
| 6,026,510 | A | | 2/2000 | Kocher |
| 6,039,677 | A | * | 3/2000 | Spletzer ..... 482/105 |
| 6,088,831 | A | * | 7/2000 | Jensen et al. ..... 2/2.5 |
| 6,129,383 | A | | 10/2000 | Kocher, Jr. |
| 6,543,055 | B2 | | 4/2003 | Howland et al. |
| 6,793,291 | B1 | | 9/2004 | Kocher |
| 7,143,446 | B1 | * | 12/2006 | Gionfriddo ..... 2/2.5 |
| 7,266,850 | B1 | | 9/2007 | Strum et al. |
| 7,386,894 | B2 | | 6/2008 | Straiton |
| 7,490,358 | B1 | | 2/2009 | Beck |
| 7,708,019 | B2 | * | 5/2010 | Kendrick ..... 128/870 |
| 7,810,167 | B2 | | 10/2010 | Siezinger et al. |
| 7,865,967 | B2 | | 1/2011 | Van Winkle et al. |
| 7,937,780 | B2 | | 5/2011 | Matic et al. |
| 7,966,923 | B2 | | 6/2011 | Daniels et al. |

(Continued)

*Primary Examiner* — Shaun R Hurley
*Assistant Examiner* — Cameron A Carter
(74) *Attorney, Agent, or Firm* — Luis Miguel Acosta; Thomas W. Saur

(57) ABSTRACT

A body armor system that includes a fabric carrier configured (i) to be worn by a user and (ii) to hold armor plates. A back armor plate is held by the carrier. A right side plate is held by the carrier and a left side plate is held by the carrier. Straps are configured to wrap horizontally across the user and matingly connect to each other. Straps integral to the carrier are configured to wrap down over the front of the user and matingly connect to the connected horizontal straps. A right thigh plate and a left thigh plate are matingly connected with straps around right and left thighs of the user.

2 Claims, 4 Drawing Sheets

(56) References Cited

U.S. PATENT DOCUMENTS

| | | | | |
|---|---|---|---|---|
| 7,987,523 | B2 * | 8/2011 | Cole et al. | 2/102 |
| 2002/0069444 | A1 * | 6/2002 | Graham et al. | 2/2.5 |
| 2004/0128734 | A1 * | 7/2004 | Jordan | 2/69 |
| 2006/0195962 | A1 * | 9/2006 | Jordan | 2/69 |
| 2006/0243126 | A1 | 11/2006 | Tyler | |
| 2009/0127396 | A1 * | 5/2009 | Jordan | 244/151 R |
| 2009/0178194 | A1 * | 7/2009 | Story | 5/81.1 R |
| 2009/0320171 | A1 | 12/2009 | Kocher et al. | |
| 2011/0035855 | A1 * | 2/2011 | Gewant | 2/2.5 |

* cited by examiner

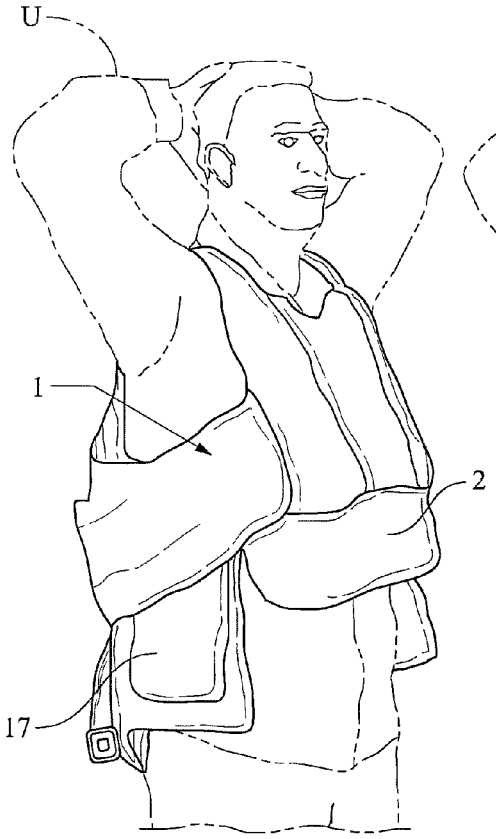
FIG. 1A
(CONVENTIONAL)
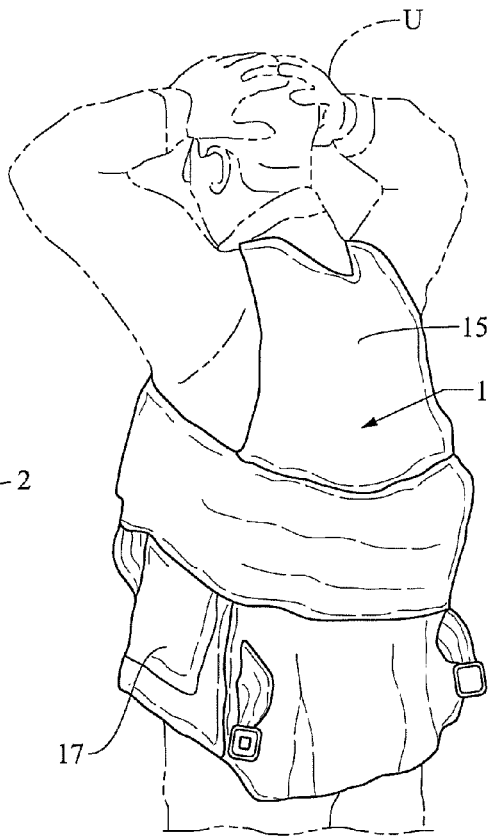
FIG. 1B
(CONVENTIONAL)

BODY ARMOR

GOVERNMENT INTEREST

The invention described here may be made, used and licensed by and for the U.S. Government for governmental purposes without paying royalty to us.

BACKGROUND OF THE INVENTION

1. Field of the Invention

The present invention generally relates to body armor.

2. Background Art

Conventional body armor for the protection of combatants has been implemented in various forms (e.g., suits of armor worn by knights in the $14^{th}$ century), as is well known to one of ordinary skill in the art. Some examples of conventional modern body armor implementations that provide various levels of ballistic protection over various regions of a body include the armor of U.S. Pat. No. 6,129,383, issued Oct. 10, 2000 ('383); U.S. Pat. No. 6,793,291 ('291), issued Sep. 21, 2004; U.S. Pat. No. 7,266,850, issued Sep. 11, 2007; U.S. Pat. No. 7,810,167, issued Oct. 12, 2010; and U.S. Published Application 2006/0243126, published November 2006. The body armor system that is substantially shown and described in the '383 and '291 patents is commercially referred to as Vehicle Body Armor Support System (abbreviated as V-BASS) (see, for example, the Abstracts of the '383 and '291 patents). The V-BASS body armor system may be procured from ArmorWorks, Phoenix, Ariz.

However, such conventional body armor implementations may have deficiencies such as, but not necessarily limited to: limited ballistic protection capabilities; limited coverage of the body to be protected; lack of constraint when used within a vehicle and thus may jostle, bump or rub a wearer; unwieldy; overly heavy; excessively hot; and/or otherwise uncomfortable for personal wear or lacking in desired protection.

SUMMARY OF THE INVENTION

Accordingly, the present invention may provide a body armor system. The system generally comprises a fabric carrier configured (i) to be worn by a user and (ii) to hold armor plates; a back armor plate held by the carrier; a right side plate held by the carrier and a left side plate held by the carrier; a right front strap integral to the carrier and a left front strap integral to the carrier, wherein the right front strap and the left front strap are configured to wrap horizontally across the user and matingly connect to each other; a right shoulder strap integral to the carrier and a left shoulder strap integral to the carrier, wherein the right shoulder strap and the left shoulder strap are configured to wrap over the front of the user and matingly connect to the connected right front strap and left front strap; a right thigh plate and a left thigh plate; an inner right thigh strap integral to the right thigh plate and having first and second ends, wherein the first inner right thigh strap end and the second inner right thigh strap end are configured to wrap around a right thigh of the user and matingly connect to each other; an outer right thigh strap integral to the right thigh plate and having first and second ends, wherein the first outer right thigh strap end and the second outer right thigh strap end are configured to wrap around the right thigh of the user and matingly connect to each other; an inner left thigh strap integral to the left thigh plate and having first and second ends, wherein the first inner left thigh strap end and the second inner left thigh strap end are configured to wrap around a left thigh of the user and matingly connect to each other; and an outer left thigh strap integral to the left thigh plate and having first and second ends, wherein the first outer left thigh strap end and the second outer left thigh strap end are configured to wrap around the left thigh of the user and matingly connect to each other.

The right thigh plate and the left thigh plate are integral to the carrier and held by the carrier.

The system further comprises a right supplemental support strap integral to the right thigh plate and configured to wrap upward and back to the front of the user and matingly connect to the connected right front strap and left front strap, and a left supplemental support strap integral to the left thigh plate and configured to wrap upward and back to the front of the user and matingly connect to the connected right front strap and left front strap.

The right and left supplemental support straps are made from a resilient material.

The system further comprises a right supplemental support strap integral to the right thigh plate and configured to wrap upward and back to the front of the user and matingly connect to the connected right front strap and left front strap, and a left supplemental support strap integral to the left thigh plate and configured to wrap upward and back to the front of the user and matingly connect to the connected right front strap and left front strap.

The right and left supplemental support straps are made from a resilient material.

Further, according to the present invention, a body armor system may be provided. The system generally comprises a fabric carrier configured (i) to be worn by a user and (ii) to hold armor plates; a back armor plate held by the carrier; a right side plate held by the carrier and a left side plate held by the carrier; a right front strap integral to the carrier and a left front strap integral to the carrier, wherein the right front strap and the left front strap are configured to wrap horizontally across the user and matingly connect to each other; a right shoulder strap integral to the carrier and a left shoulder strap integral to the carrier, wherein the right shoulder strap and the left shoulder strap are configured to wrap over the front of the user and matingly connect to the connected right front strap and left front strap; a right thigh plate and a left thigh plate; an inner right thigh strap integral to the right thigh plate and having first and second ends, wherein the first inner right thigh strap end and the second inner right thigh strap end are configured to wrap around a right thigh of the user and matingly connect to each other; an outer right thigh strap integral to the right thigh plate and having first and second ends, wherein the first outer right thigh strap end and the second outer right thigh strap end are configured to wrap around the right thigh of the user and matingly connect to each other; an inner left thigh strap integral to the left thigh plate and having first and second ends, wherein the first inner left thigh strap end and the second inner left thigh strap end are configured to wrap around a left thigh of the user and matingly connect to each other; and an outer left thigh strap integral to the left thigh plate and having first and second ends, wherein the first outer left thigh strap end and the second outer left thigh strap end are configured to wrap around the left thigh of the user and matingly connect to each other; wherein the bottom edge of the back plate comprises a back plate channel, the bottom edge of the right side plate comprises a right side plate channel, and the bottom edge of the left side plate comprises a left side plate channel; and the back plate channel is connected at a first end to the right side plate channel via a first multi-directional resistive joint, and the back plate channel is connected at a second end to the left side plate channel via a second multi-directional resistive joint.

The back plate is mounted into the back plate channel, the right side plate is mounted into the right side plate channel, and the left side plate is mounted into the left side plate channel by at least one of ribs or barbs on the inner top edges of the channel, or an adhesive on the inner bottom of the channel.

The system further comprises a right supplemental support strap integral to the right thigh plate and configured to wrap upward and back to the front of the user and matingly connect to the connected right front strap and left front strap, and a left supplemental support strap integral to the left thigh plate and configured to wrap upward and back to the front of the user and matingly connect to the connected right front strap and left front strap.

The right and left supplemental support straps are made from a resilient material.

In addition, according to the present invention, a body armor system may be provided. The system generally comprises a fabric carrier configured (i) to be worn by a user and (ii) to hold armor plates; a back armor plate held by the carrier; a right front strap integral to the carrier and a left front strap integral to the carrier, wherein the right front strap and the left front strap are configured to wrap horizontally across the user and matingly connect to each other; a right shoulder strap integral to the carrier and a left shoulder strap integral to the carrier, wherein the right shoulder strap and the left shoulder strap are configured to wrap over the front of the user and matingly connect to the connected right front strap and left front strap; a right thigh plate and a left thigh plate; an inner right thigh strap integral to the right thigh plate and having first and second ends, wherein the first inner right thigh strap end and the second inner right thigh strap end are configured to wrap around a right thigh of the user and matingly connect to each other; an outer right thigh strap integral to the right thigh plate and having first and second ends, wherein the first outer right thigh strap end and the second outer right thigh strap end are configured to wrap around the right thigh of the user and matingly connect to each other; an inner left thigh strap integral to the left thigh plate and having first and second ends, wherein the first inner left thigh strap end and the second inner left thigh strap end are configured to wrap around a left thigh of the user and matingly connect to each other; and an outer left thigh strap integral to the left thigh plate and having first and second ends, wherein the first outer left thigh strap end and the second outer left thigh strap end are configured to wrap around the left thigh of the user and matingly connect to each other; wherein the bottom edge of the right side plate comprises a right side plate channel having an inner end and an outer end, the bottom edge of the left side plate comprises a left side plate channel having an inner end and an outer end, the bottom edge of the right thigh plate comprises a right thigh plate channel, and the bottom edge of the left thigh plate comprises a left thigh plate channel; and the right thigh plate channel is connected to the right side plate channel outer end via a first multi-directional resistive joint, and the left thigh plate channel is connected to the left side plate channel outer end via a second multi-directional resistive joint.

The right side plate is mounted into the right side plate channel, the left side plate is mounted into the left side plate channel, the right thigh plate is mounted into the right thigh plate channel, and the left thigh plate is mounted into left thigh plate channel by at least one of ribs or barbs on the inner top edges of the channel, or an adhesive on the inner bottom of the channel.

The system further comprises a right supplemental support strap integral to the right thigh plate and configured to wrap up to the front of the user and matingly connect to the connected right front strap and left front strap, and a left supplemental support strap integral to the left thigh plate and configured to wrap up to the front of the user and matingly connect to the connected right front strap and left front strap.

The right and left supplemental support straps are made from a resilient material.

The bottom edge of the back plate comprises a back plate channel; and the back plate channel is connected on the right side at the inner end of the right side plate channel via a third multi-directional resistive joint, and the back plate channel is connected on the left side at the inner end of the left side plate channel via a fourth multi-directional resistive joint.

The back plate is mounted into back plate channel by at least one of ribs or barbs on the inner top edges of the channel, or an adhesive on the inner bottom of the channel.

The system further comprises a right supplemental support strap integral to the right thigh plate and configured to wrap up to the front of the user and matingly connect to the connected right front strap and left front strap, and a left supplemental support strap integral to the left thigh plate and configured to wrap up to the front of the user and matingly connect to the connected right front strap and left front strap.

The right and left supplemental support straps are made from a resilient material.

The above features, and other features and advantages of the present invention are readily apparent from the following detailed descriptions thereof when taken in connection with the accompanying drawings.

BRIEF DESCRIPTION OF THE DRAWINGS

FIGS. 1(A-B) are right side plus front, and left side plus rear views, respectively, of an implementation of conventional body armor as worn;

DETAILED DESCRIPTION OF THE PREFERRED EMBODIMENT(S)

Figure 2:
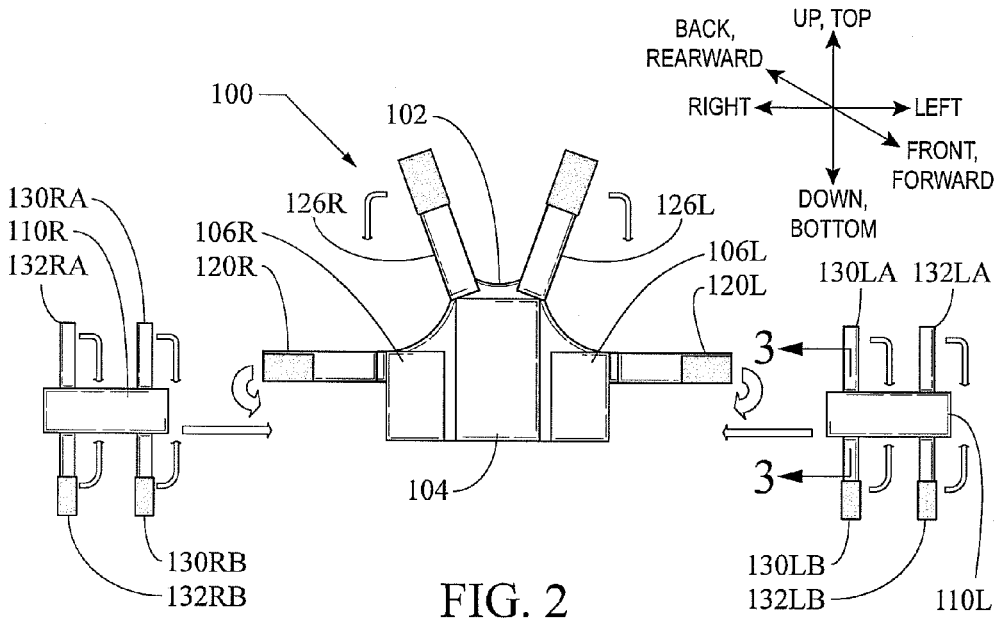
FIG. 2 is a schematic, front view of an embodiment of body armor of the present invention.

Definitions and Terminology:

The following definitions and terminology are applied as understood by one skilled in the appropriate art.

The singular forms such as "a," "an," and "the" include plural references unless the context clearly indicates otherwise. For example, reference to "a material" includes reference to one or more of such materials, and "an element" includes reference to one or more of such elements.

As used herein, "substantial" and "about", when used in reference to a quantity or amount of a material, characteristic, parameter, and the like, refer to an amount that is sufficient to provide an effect that the material or characteristic was intended to provide as understood by one skilled in the art. The amount of variation generally depends on the specific implementation.

A plurality of items, structural elements, compositional elements, materials, subassemblies, and the like may be presented in a common list or table for convenience. However, these lists or tables should be construed as though each member of the list is individually identified as a separate and unique member. As such, no individual member of such list should be considered a de facto equivalent of any other member of the same list solely based on the presentation in a common group so specifically described.

Concentrations, values, dimensions, amounts, and other quantitative data may be presented herein in a range format. One skilled in the art will understand that such range format is used for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 dimensional unit to about 100 dimensional units should be interpreted to include not only the explicitly recited limits, but also to include individual sizes such as 2 dimensional units, 3 dimensional units, 10 dimensional units, and the like; and sub-ranges such as 10 dimensional units to 50 dimensional units, 20 dimensional units to 100 dimensional units, and the like.

Directional references to left (generally designated via the suffix, L), right (generally designated via the suffix, R), front, back (rear), top, bottom, up (upward), and down (downward) are made with respect to a human body, the body generally including torso, head (supported by neck), and limbs (e.g., arms and legs). When reference is made to a vehicle or an implementation of the invention in connection with a vehicle, the directions are generally that of the vehicle body. See, also, FIGS. 2 and 3.

Unless specifically indicated otherwise, elements herein that are numbered less than 100 refer to conventional elements; while elements that are numbered 100 and greater refer to elements of the present invention.

With reference to the Figures, the preferred embodiments of the present invention will now be described in detail. Generally, the present invention provides an improved system for body armor, in particular, a body (e.g., personal, individual, etc.) armor system (apparatus, device, and the like) 100.

The body armor system 100 generally comprises an improvement to the body armor systems of U.S. Pat. No. 6,129,383, issued Oct. 10, 2000 to Kocher (hereinafter the '383 patent); and U.S. Pat. No. 6,793,291, issued Sep. 21, 2004 to Kocher (hereinafter the '291 patent); both of which are incorporated by reference in their entirety. The '383 and '291 patents illustrate and describe armor systems that may be implemented in connection with a vehicle. Specific reference to the FIGS. and the elements of the '383 and '291 patents will use the numbering contained therein; and reference to the respective patent will be included because, in some instances, as between the '383 and '291 patents, the same or similar elements incorporate different element numbering. In particular, the body armor 100 may provide improved protection to the femoral artery region (e.g., thigh region) of a user especially when the user is standing or moving outside the vehicle, as well as other improved features and benefits, when compared to the convention body armor of the '383 and '291 patents.

Referring to FIGS. 1(A-B), side plus front, and side plus rear views, respectively, of an implementation of conventional body armor of the '383 patent is shown as worn by a user (e.g., person, vehicle occupant, Soldier, war fighter, prisoner, detainee, reporter, journalist, etc.), U; when the user, U, is standing outside of the vehicle. As shown in the '383 patent on FIG. 10 and described in column 1, lines 50, 51, 65, and 67, the armor of the '383 patent comprises a ballistic material carrier, 1; a ballistic front plate, 2; a back plate, 15; and a side armor plate, 17. As described in column 2, lines 6-9, "The basic material carrier [vest, at column 2, line 18] 1 is worn by the occupant and bears the load of the armor system when the vehicle occupant is standing or outside the vehicle."

Note that in the '383 patent on FIGS. 10-12, and in the '291 patent on FIGS. 1-4, right side elevations views of the respective armors when the user, U, is seated inside of the vehicle are illustrated. In the '383 patent, all of the FIGS. illustrate various example implementations of support strut elements 6 and 10 and the related components that are configured to transfer weight of the armor to the vehicle seat ('383 patent, Abstract). In the '291 patent, the support system allows direct transfer of the armor system weight to the seat or other points of the vehicle ('291 patent, Abstract). Load transferring attachments include straps or elastic system 13 that takes into consideration the motion and movement of the vehicle ('291 patent, FIG. 11, and column 4, lines 3-11). The armor system 100 may be configured to implement the transfer of the armor system weight to the seat or other points of the vehicle as provided in the '383 and '291 patents while providing further advantages and benefits to the user, U. The armor system 100 may be configured to be installed (e.g., mounted to supports) inside the vehicle such that the user, U, climbs into the vehicle and dons the system 100. Alternatively, the armor system 100 may be configured to be essentially portable; that is, worn outside of the vehicle as well as inside of the vehicle.

Referring to FIG. 2, a front, schematic (i.e., exploded, unfolded) view illustrating an embodiment of the body (e.g., personal, individual, etc.) armor system (apparatus, device, and the like) 100 is shown. The armor 100 generally comprises a ballistic fabric material carrier (e.g., vest) 102, a ballistic back plate 104, right (R) side and left (L) side ballistic plates 106 (e.g., plates 106R and 106L), and right thigh protector and left thigh protector ballistic plates 110 (e.g., plates 110R and 110L). The armor system 100 may be implemented in connection with a front ballistic plate that is similar to the front plate 2 of the '383 patent to provide substantially complete ballistic event protective coverage of the user, U, torso and thigh regions.

When the occupant, U, is inside the vehicle, the ballistic plates 104, 106, and 110 may be supported via support mechanisms that are implemented similarly to the supports illustrated and described in the '383 and '291 patents. Note, however; the '383 and '291 patents generally fail to include the additional, separate right thigh protector and left thigh protector ballistic plates (e.g., the thigh protector ballistic plates 110 of the present invention). Further, the '383 and '291 patents generally fail to provide support for any of the ballistic plates across substantially the entire length of the lower edge of the ballistic plates. The '383 and '291 patents generally only provide support at point locations. In contrast, the armor system 100 generally provides more complete, stable, and secure support to the plates 104, 106, and 110. See, in particular, FIGS. 7 and 8(A-E) and related description below.

The carrier 102 is generally made from high strength and flexible fabric such as nylon (e.g., Cordura™) or the like as is well known to one of skill in the art. The carrier 102 is generally implemented having pockets or cavities (for clarity of illustration and explanation, not shown) that are sized and configured to securely hold respective ballistic plates 104 and 106. The pockets that hold the ballistic plates 104 and 106 may be implemented similarly to the pockets as shown and described, for example, in U.S. Pat. No. 7,266,850, issued Sep. 11, 2007 to Strum, et al. as element 308 on FIG. 3, and column 4, lines 33-58. The plates 104, 106, and 110 may be implemented as any appropriate ballistic protective material (e.g., ballistic fabric in a plate shaped configuration, metal such as hot rolled steel, ceramic, and the like as is known to one of skill in the art).

The vest 102 further comprises integral right front and left front straps 120 (e.g., front straps 120R and 120L); integral right top and left top straps 126 (e.g., top straps 126R and 126L). The straps 120 may be implemented similarly to the straps 4 of the '291 patent, and the straps 129 may be implemented similarly to the straps 3 of the '291 patent. The straps 120 and 126 are generally implemented having adjustable lengths. When worn by the user, U, the right front and left front straps 120 are generally wrapped horizontally forward and fastened (matingly connected) to each other to form a combination ("cummerbund") across the front of the user, U, and over the front ballistic plate; and the right top and left top straps 126 are generally wrapped forward and down, and fastened over and to the cummerbund formed by the front straps 120. Such an implementation may be similar to the conventional implementation as illustrated on FIG. 1.

The connections (fastening) implemented in connection with the system 100 straps (e.g., the straps 120 and 126, and other straps described below) may be implemented via attachment members including quick release mechanisms such as aircraft or automotive-type complementary tangs and buckles, snaps, loop and square rings or D-rings, hook and loop (or eye) fasteners (e.g., Velcro™), and the like. For simplicity and clarity of illustration and discussion, the connections are generally illustrated as hook and loop fasteners; however, the strap related connections may be implemented as any appropriate attachments to meet the design criteria of a particular application as is known to one of skill in the art.

The right thigh protector and left thigh protector ballistic plates 110 each further comprise respective pairs of right (R) and left (L) mating, similar, complementary (A and B) inner (first) and outer (second) retention straps 130 and 132 (e.g., first (inner) retention strap pairs 130RA and 130RB, and 130LA and 130LB; and second (outer) retention strap pairs 132RA and 132RB, and 132LA and 132LB). As such, in one example, the right thigh protector and left thigh protector ballistic plates 110 may be implemented integrally with the vehicle (e.g., installed in the vehicle). The straps 130 and 132 may be implemented having adjustable lengths. When the occupant, U, is seated in the vehicle, the retention straps 130 and 132 may then be fastened to secure the right thigh protector and left thigh protector ballistic plates 110. Such an embodiment may provide the user, U, a lighter and more mobile weight burden when outside of the vehicle and yet provide more ballistic protection that is mechanically secure when inside the vehicle.

Figure 3:
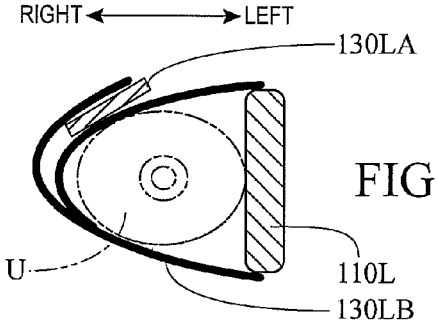
FIG. 3 is a sectional view of a portion of the body armor of the present invention.

Referring to FIG. 3, a sectional view taken at line 3-3 of FIG. 2 illustrating the installation of the left thigh protector ballistic plate 110L around the outer (relative to the vehicle) left thigh of the user, U, is shown. The right thigh protector ballistic plate 110R is generally worn in a similar manner on the right thigh of the user, U.

Figure 4:
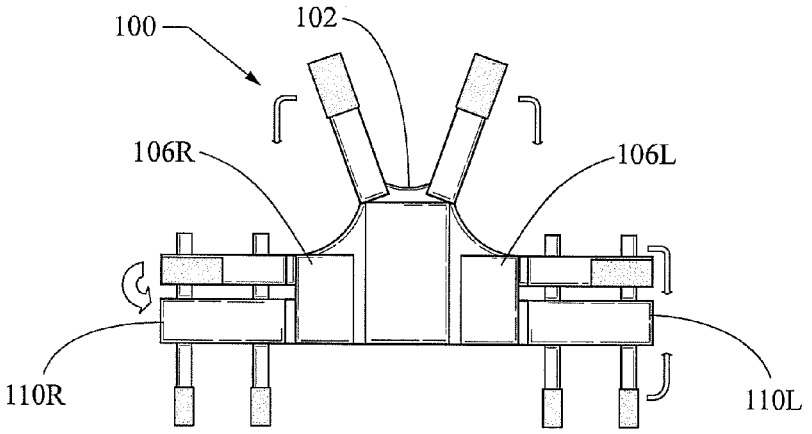
FIG. 4 is a schematic, front view of another embodiment of body armor of the present invention.

Referring to FIG. 4, a front, schematic (i.e., exploded, unfolded) view illustrating another embodiment of the body armor system 100 is shown. Compared to the embodiment of the system 100 of FIG. 2, the vest 102 integrally includes the right thigh protector and left thigh protector ballistic plates 110 similarly to the inclusion of the side plates 106.

Figure 5:
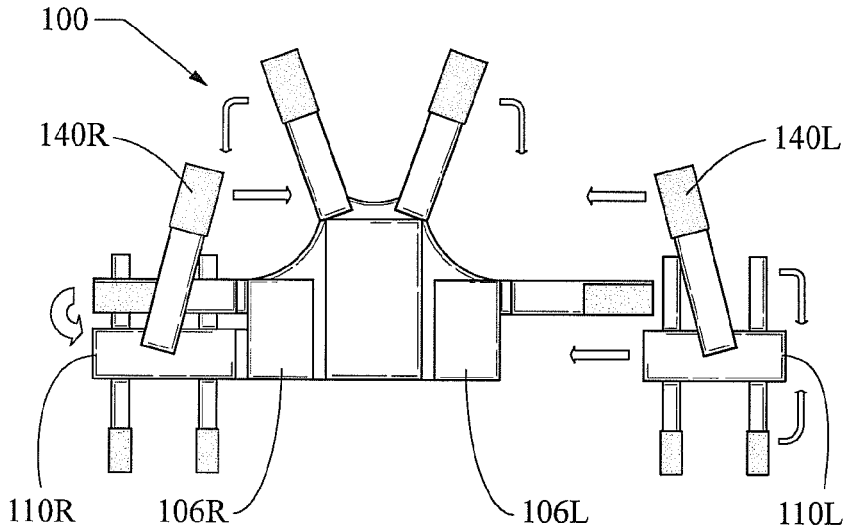
FIG. 5 is a schematic, front view of another embodiment of body armor of the present invention.

Referring to FIG. 5, a front, schematic (i.e., exploded, unfolded) view illustrating another embodiment of the body armor system 100 is shown. In particular, the system 100 further comprises right and left supplemental support straps 140 (e.g., supplemental support straps 140R and 140L). The right and left supplemental support straps 140 are generally implemented (i.e., connected, fastened, hooked up, etc.) between the right thigh protector and left thigh protector ballistic plates 110 and the front of the carrier 102.

The right side of the body armor 100 is illustrated implemented similarly to the embodiment as illustrated on FIG. 2; that is, the right thigh protector ballistic plate 110R is separate from the vest 102. The left side of the body armor 100 is illustrated as implemented similarly to the embodiment illustrated on FIG. 4; that is, the left thigh protector ballistic plate 110L is integral to the vest 102. The right and left supplemental support straps 140 may be advantageously implemented with any embodiment of the vest 102 implementation of the system 100.

Figure 6:
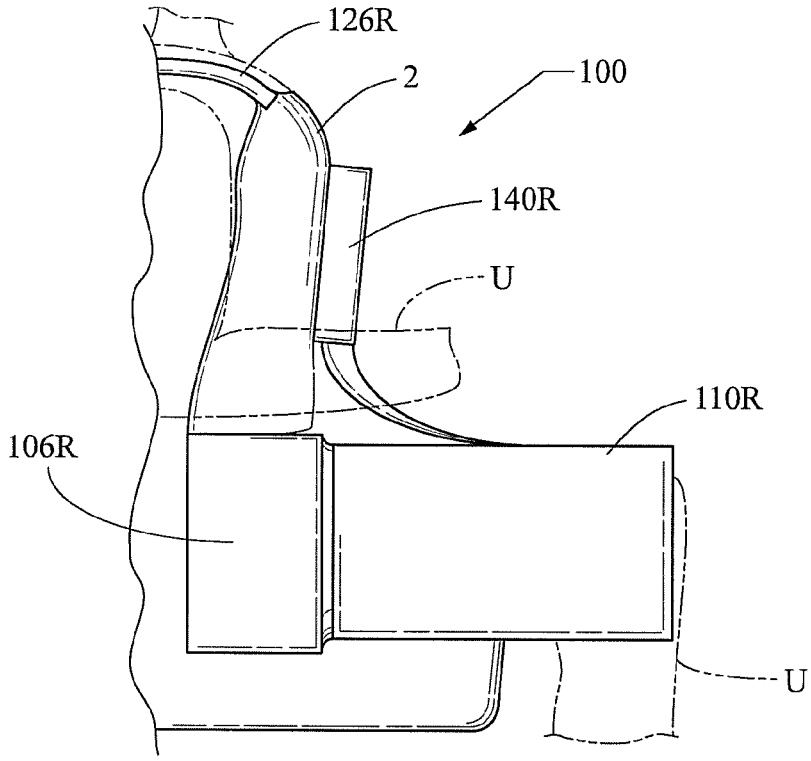
FIG. 6 is a right side elevation view of the embodiment of body armor of FIG. 5.

Referring to FIG. 6, a broken (partial) right side elevation view of the armor 100 is shown. The right side of the vehicle occupant, U, is shown in a seated position. In the embodiment illustrated, a front plate 2 is implemented. The right thigh protector plate 110R as illustrated, extends forward to provide ballistic protection to the thigh and knee regions of the user, U. The thigh protector ballistic plates 110 are generally fastened around the thighs of the occupant, U, as illustrated and described above in connection with FIG. 2.

Also illustrated is the supplemental support strap 140R as installed, that is, extended upward and back, and connected between the carrier 102 at the front plate 2 and the right thigh protector plate 110R. The straps 140 may be implemented having adjustable lengths. The supplemental support straps 140 are generally implemented with a resilient (e.g., stretchable, compliant) material (e.g., elastic, rubber, and the like) that provides support to the thigh protector plates 110. The resilient material that is implemented in the support straps 140 is generally selected to provide support of the thigh protector plates 110 when the user, U, is standing and when the user, U, is seated. Such support may reduce the weight loading on the thigh region of the user, U, such that the user, U, generally has superior mobility due to the motion of the thigh having less weight to contend with.

Figure 7:
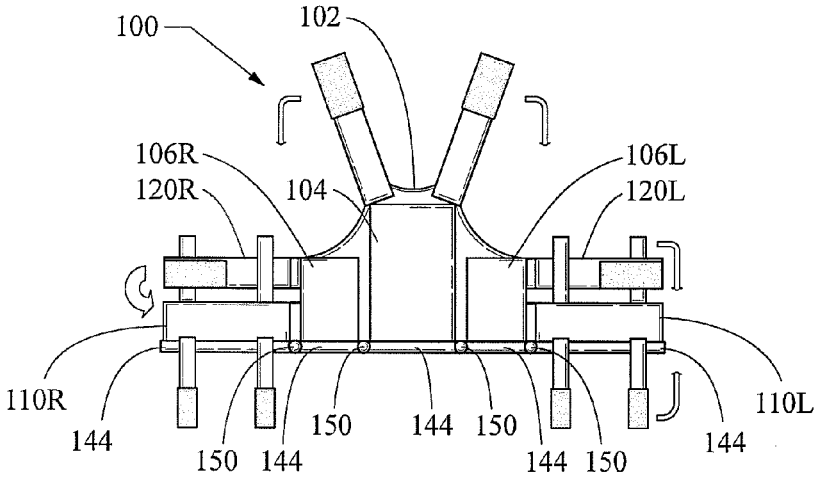
FIG. 7 is a schematic, front view of another embodiment of body armor of the present invention.

Referring to FIG. 7, a front, schematic (i.e., exploded, unfolded) view illustrating another embodiment of the body armor system 100 is shown. In particular, the system 100 further comprises one or more support channels 144, and one or more joints 150. While illustrated having a structure similar to the system 100 embodiment illustrated on FIG. 4 (that is, the connection between the back plate 104 and the side plates 106 is implemented via the joints 150 instead of fabric of the vest 102), the support channels 144 and/or the joints 150 may be advantageously implemented in connection with any of the features and embodiments that are implemented in connection with the system 100 illustrated on FIGS. 2, 4, and 5.

The support channels 144 are generally implemented to provide support under one or more, but not necessarily any or all, of the ballistic plates 104, 106, and 110, hence reduced weight load on the user, U. The support channels 144 may be mounted in the vehicle similarly to the upper support strut attachment 5 of the '383 patent. However; the channels 144 are generally implemented having a more supportive length than the essentially single point implementations that are implemented in the patent '383. For example, the plates 104,

106R, 110R, and 110L are illustrated having channels 144 across the entire lower (bottom) edge, while the plate 106L has a channel 144 across a portion (e.g., about one-half) of the lower edge. As such, the channels 144 may provide more stable and complete support of the ballistic plates 104, 106, and 110 than is provided by the conventional upper support strut attachment 5 of the '383 patent.

The joints 150 may be implemented at one or more, but not necessarily any or all, of interfacing junction (interfaces) between adjacent ballistic plates 104, 106 and 110. The joints 150 are generally implemented as resistive, multi-directional articulating joints (e.g., ball joint, gimbals/gimbal, coupling, and the like). The joints 150 may, in one example, be implemented substantially as the ball joint coupling as shown and described in U.S. Pat. No. 807,857, issued Dec. 19, 1905 to Palmenberg; U.S. Pat. No. 2,670,228, issued Feb. 23, 1954 to Pagliuso; U.S. Pat. No. 2,752,116, issued Jun. 26, 1956 to Minnis; and U.S. Pat. No. 4,708,510, issued Nov. 24, 1987 to McConnell et al.; all of which are incorporated by reference in their entirety. However, the coupling 150 may be implemented as any appropriate resistive and/or quick locking multi-directional joint mechanism to meet the design criteria of a particular application.

The joints 150 generally provide distributed support between adjacent ballistic plates 104, 106 and 110. The joints 150 are generally implemented with the channels 144 between adjacent ballistic plates 104, 106 and 110. That is, the channels 144 may be included at (on) the bottom edge of ballistic plates 104, 106 and 110 and the joints 150 may provide a resistive, multi-directional mechanical connection between adjacent channels 144 (e.g., between the channel on the bottom edge of the back plate 102 and the inner end of the channel 144 on the bottom edge of the side plate 106; and between the outer end of the channel 144 on the bottom edge of the side plate 106 and the channel 144 on the bottom edge of thigh plate 110). As such, the joints 150 (as well as the adjustable straps 120, 126, 130, 132, and 140) generally further provide the capability for the user, U, to rapidly multi-directionally, rotationally and linearly adjust the fit and position of the components of the system 100 in any direction to a comfortable yet protective configuration whether seated inside the vehicle or standing and/or moving outside the vehicle.

Referring to FIGS. 8(A-E), end (or cross sectional) views of example embodiments of the channel 144 are illustrated. The channel 144 (and the plates 104, 106, and 110—not illustrated for clarity) is illustrated as typically installed when mounted in the vehicle via a support strut (e.g., a support strut similar to element 6 of the '383 patent). When the system 100 not intended to be mounted in the vehicle, the support strut is not implemented. The edge of the ballistic plates 104, 106, and/or 110 (generally enclosed in fabric of the vest 102, not shown to avoid clutter in the illustrations) rests or is affixed in the channel 144.

Figure 8A:
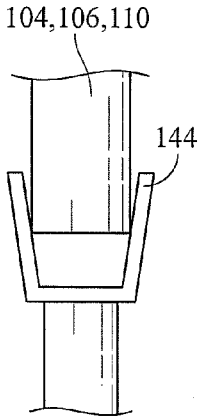
FIGS. 8(A-E) are end views of embodiments of a channel of the present invention.
Figure 8B:
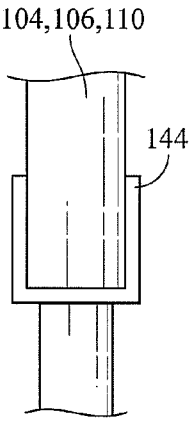
Figure 8C:
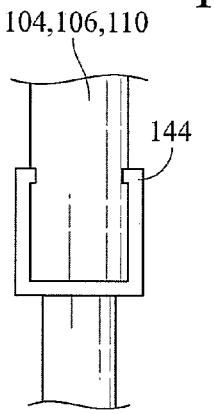
Figure 8D:
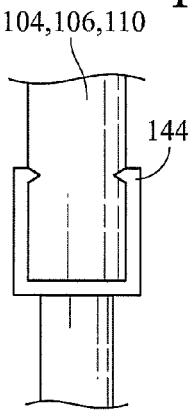
Figure 8E:
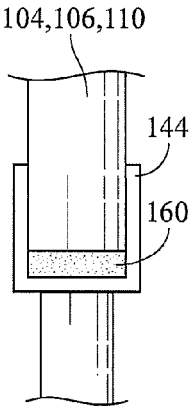

FIG. 8A illustrates an embodiment having a truncated "V" shape channel with legs pointed upward; FIG. 8B illustrates an embodiment having a square "C" or "U" channel with legs pointed upward and smooth walls (note, the channel 144 having a rounded bottom, not illustrated, may be implemented as another embodiment); FIG. 8C illustrates an embodiment having a square "C" or "U" channel with legs pointed upward and walls with flat horizontal inwardly pointed ribs at the top edge, wherein the ribs grab the plates 104, 106, and 110; FIG. 8D illustrates an embodiment having a square "C" or "U" channel with legs pointed upward and walls with horizontal inwardly pointed barbs at the top edge, wherein the barbs grab the plates 104, 106, and 110; and FIG. 8E illustrates an embodiment having a square "C" or "U" channel with legs pointed upward and smooth walls with an adhesive 160 at the bottom. The adhesive 160 is generally implemented as glue or as double-backed adhesive tape. The embodiments of FIGS. 8A and 8B are generally implemented when it is intended to temporarily mount the ballistic plates 104, 106, and/or 110 in the channel 144. The embodiments of FIGS. 8(C-F) are generally implemented when it is intended to substantially permanently mount the ballistic plates 104, 106, and/or 110 or the vest 102 (as the pocket where the plate is enclosed in the vest 102 may be configured to provide plate replacement) in the channel 144.

As is apparent then from the above detailed description, the present invention may provide an improved system personal body armor. Such a system in its alternative embodiments may reduce or overcome various deficiencies of conventional personal body armor.

Various alterations and modifications will become apparent to those skilled in the art without departing from the scope and spirit of this invention and it is understood this invention is limited only by the following claims.

What is claimed is:

1. A ballistic body armor system, the system comprising:

a fabric carrier configured (i) to be worn by a user and (ii) to hold armor plates;

a right side plate held by the carrier and a left side plate held by the carrier;

a back armor plate held by the carrier;

a right front strap integral to the carrier and a left front strap integral to the carrier, wherein the right front strap and the left front strap are configured to wrap horizontally across the user and matingly connect to each other;

a right shoulder strap integral to the carrier and a left shoulder strap integral to the carrier, wherein the right shoulder strap and the left shoulder strap are configured to wrap over the front of the user and matingly connect to the connected right front strap and left front strap;

a right thigh plate and a left thigh plate;

an inner right thigh strap integral to the right thigh plate and having first and second ends, wherein the first inner right thigh strap end and the second inner right thigh strap end are configured to wrap around a right thigh of the user and matingly connect to each other;

an outer right thigh strap integral to the right thigh plate and having first and second ends, wherein the first outer right thigh strap end and the second outer right thigh strap end are configured to wrap around the right thigh of the user and matingly connect to each other;

an inner left thigh strap integral to the left thigh plate and having first and second ends, wherein the first inner left thigh strap end and the second inner left thigh strap end are configured to wrap around a left thigh of the user and matingly connect to each other; and an outer left thigh strap integral to the left thigh plate and having first and second ends, wherein the first outer left thigh strap end and the second outer left thigh strap end are configured to wrap around the left thigh of the user and matingly connect to each other;

wherein the bottom edge of the right side plate comprises a right side plate support channel having an inner end and an outer end, the bottom edge of the left side plate comprises a left side plate support channel having an inner end and an outer end, the bottom edge of the right thigh plate comprises a right thigh plate support channel, and the bottom edge of the left thigh plate comprises a left thigh plate support channel; and the right thigh plate support channel is connected to the right side plate support channel outer end via a first multi-directional resistive joint, and the left thigh plate support channel is connected to the left side plate support channel outer end via a second multi-directional resistive joint.

2. The ballistic body armor system of claim 1, wherein the bottom edge of the back plate comprises a back plate support channel; and the back plate support channel is connected on the right side at the inner end of the right side plate support channel via a third multi-directional resistive joint, and the back plate support channel is connected on the left side at the inner end of the left side plate support channel via a fourth multi-directional resistive joint.

* * * * *